US005348793A

United States Patent [19]

Stettner

[11] Patent Number: 5,348,793

[45] Date of Patent: Sep. 20, 1994

[54] PAPER WEB SPLICE TAPE

[75] Inventor: Gerd Erich Stettner, Stadtlauringen, Fed. Rep. of Germany

[73] Assignee: Koenig & Bauer Aktiengesellschaft, Wurzburg, Fed. Rep. of Germany

[21] Appl. No.: 37,589

[22] Filed: Mar. 26, 1993

[30] Foreign Application Priority Data

Mar. 30, 1992 [DE] Fed. Rep. of Germany ..... 4210329

[51] Int. Cl.[5] ..... C09J 7/02

[52] U.S. Cl. ..... 428/211; 428/343; 428/354; 242/556.1

[58] Field of Search ..... 428/40, 343, 354, 211; 242/58.5

[56] References Cited

U.S. PATENT DOCUMENTS

| | | | |
|---|---|---|---|
| 2,149,833 | 3/1939 | Bernard | 242/58.5 |
| 2,377,971 | 6/1945 | Roesen | 242/58.5 |
| 3,006,568 | 10/1961 | Willis | 242/58.5 |
| 3,231,949 | 2/1966 | Phipps | 242/58.5 |
| 4,905,924 | 3/1990 | Moore | 242/58.5 |
| 5,212,002 | 5/1993 | Madrzak | 428/354 |

FOREIGN PATENT DOCUMENTS

| | | | |
|---|---|---|---|
| 0418527A2 | 8/1990 | European Pat. Off. . | |
| 0418527A3 | 8/1990 | European Pat. Off. . | |
| 4020954 | 6/1990 | Fed. Rep. of Germany . | |
| 4033900 | 10/1990 | Fed. Rep. of Germany . | |
| 1098784 | 5/1986 | Japan | 428/40 |

*Primary Examiner*—Jenna L. Davis
*Attorney, Agent, or Firm*—Jones, Tullar & Cooper

[57] ABSTRACT

A paper web splice tape which is usable to splice a free end of a new paper web to a depleting paper web is formed as a double sided adhesive tape. A continuous high strength adhesive layer is provided on an outer surface of the splice tape and is engageable with the depleting web. The inner side of the splice tape is separated into a high strength adhesive zone, an adhesive free zone and an easily releasable adhesive zone.

3 Claims, 2 Drawing Sheets

PAPER WEB SPLICE TAPE

FIELD OF THE INVENTION

The present invention is directed generally to a paper web splice tape. More specifically, the present invention is directed to a paper web splice tape for use in splicing paper webs. Most particularly, the present invention is directed to a paper web splice tape for splicing a leading end of a standby paper web reel to a depleting web of a depleting paper web reel in a web-fed rotary printing press. The paper web splice tape has a high adhesive strength continuous adhesive layer applied to a first side of a carrier strip and has spaced low and high adhesive strength layers applied to spaced zones on the second side of the carrier strip. The paper web splice tape is applied to the leading end of the paper web on the standby reel with the continuous high straight adhesive layer facing the depleting web. During web splicing, the various strength adhesive layers function to insure a smooth, efficient splice.

DESCRIPTION OF THE PRIOR ART

In web fed rotary printing press assemblies, the material being printed, which is typically a continuous web of paper, is provided in the form of a paper web roll which is supported and rotated by a reel stand. As the paper web from a first web roll is depleted, it becomes necessary to splice the depleting web to a leading end of a paper web of a full, standby paper web roll. Once the splice has been accomplished, the depleted paper web is cut or otherwise severed behind the splice and the feed to the printing machine is now from the newly spliced in paper web roll. So that printing production will not be held up, these splices are made at full operating speed and are typically referred to as flying splices.

In the European document No. EP 04 18 527 A2 there is disclosed a procedure and device for preparing a roll of web-shaped printing material for an automatic roll change. An adhesive strip is applied to the leading edge of the web material on the full standby reel. This adhesive strip is used to secure the leading edge of the roll of printing material on the reel to the underlying or second layer of material on the reel. This adhesive strip is divided over its entire length into three zones. Two of the zones on one side of the strip are provided with an adhesive and the central zone between the two adhesive zones is adhesive free and is perforated. The line of perforation serves to separate the adhesive strip in its longitudinal direction. In use, a part of the adhesive strip remains on the splice area of the old, depleting web with the new web and the other part of the adhesive strip, on the other side of the perforation line, remains on the second layer of the new web and runs through the printing press when the second layer of the new web is unwound.

The use of this prior art web splicing strip may result in several possible problems. Since the strip is perforated longitudinally and intended to separate along this line of perforation during web splicing, it is possible that the splice may be accompanied by jerks or jolts as the non-perforated areas of the splicing strip are separated. These jerks or jolts can cause a tearing of the paper web to be spliced or can result in a deformation of the web. Another possible limitation of this prior art assembly is that the perforation is positioned, looking in the unwinding direction of the paper web, ahead of the splicing zone. The result of this is that during the pressing of the two webs to be spliced together, the separation of the perforation zone may start at the same time as, or even before the enactment of the splicing operation. This can result in an imperfect splice connection between the two paper webs which are to be spliced together. A further possible limitation of this prior art splicing tape is that the splice tape has a non-uniform cross-sectional thickness. This means that this splice tape cannot be stored in a wound up roll. This is a distinct disadvantage from the standpoint of storage of the splice tape as well as for the automatic supply of the splice tape for the preparation of a splice area for webs of material stored on reels.

Another splice tape and its method of use is shown in German published unexamined patent application No. 40 33 900 A1. This document discloses the production of a splice at the leading edge of an angled web by the use of an adhesive tape. This adhesive tape is, when looked at in cross-section, provided on the adhesive-free side at one end with an adhesive strip that is coated on both sides with an adhesive. A softly gluing layer of the adhesive strip is arranged on the adhesive-free side of the adhesive tape and thus forms a pre-determined tear point between the adhesive tape and the applied adhesive strip. The adhesive tape that is made in accordance with this prior art disclosure is secured to the standby roll, in preparation for accomplishing a splice of the standby roll's web, with its gluing side at the underside of the free end of the upper layer in such a way that a part of the adhesive tape projects out so that it will receive or engage the unwinding web of a depleting roll. With the adhesive strip, arranged on the reverse side, the free end of the paper web is fixed to the second layer of the paper standby roll.

A limitation of this prior art arrangement is that for the preparation of the splice at the new standby roll or the so-called web fold, the leading edge of the paper web has to be folded in a loop-like manner. This is required so that the adhesive tape can be fixed to the underside of the leading edge of the paper-web. Such a folding of the leading edge of the paper web is not beneficial and may result in less than satisfactory web splicing.

It will thus be apparent that a need exists for a paper web splice tape that overcomes the various limitations of the prior art devices. The paper web splice tape of the present invention, as will be discussed in detail subsequently, provides such a device and is a significant improvement over the prior art devices.

SUMMARY OF THE INVENTION

It is an object of the present invention to provide a paper web splice tape.

Another object of the present invention is to provide a web splice tape for splicing paper webs.

A further object of the present invention is to provide a paper web splice tape for use in splicing a leading edge of a new standby web to a depleting web.

Still another object of the present invention is to provide a paper web splice tape having a symmetrical cross-section.

Yet a further object of the present invention is to provide a paper web splice tape which is easily applied to a leading edge of a web on a standby roll.

Even another object of the present invention is to provide a paper web splice tape which disconnects from the second layer of the standby roll once the splice with the depleted roll has been accomplished.

As will be discussed in greater detail in the description of the preferred embodiments which are set forth subsequently, the paper web splice tape in accordance with the present invention utilizes a carrier strip which is provided on a first side with a continuous coating or layer of a high strength adhesive. The second side of the carrier strip or tape has a high strength adhesive in a longitudinal band along a first zone and a quick release adhesive in a longitudinal band along a second zone. These two bands are separated by a non-adhesive central band. This quick release adhesive may either be a low strength one time adhesive or may be a strong adhesive that is adhered to the second side of the carrier strip by a cleavage adhesive. The web splice tape is applied to the standby paper web reel along a free edge of a first layer which is cut at an inclined angle. The splice tape is applied to the standby web by placement of the high strength adhesive band of the second side of the tape on the outer surface of the first layer of paper web on the standby reel and by placing the quick release adhesive band on the second layer. The continuous layer of high strength adhesive on the first side of the splice tape faces outwardly and is engaged by the depleting web to accomplish a flying web splice.

The paper web splice tape in accordance with the present invention has several advantages over the various prior art tapes. Since it is provided with adhesive layers on both sides of the carrier strip and since these adhesive layers have different adhesive capabilities, the leading edge of the web on the standby reel can be affixed to the second layer of the web in a manner which holds the leading edge securely until such time as the splice is to be accomplished. This eliminates the need to form a loop-like arrangement on the leading edge of the web on the standby reel or the need to calculate in advance where the adhesive will be applied on the second layer of the standby web reel so as to avoid adhesive contamination of the printing press or the web, all as was required in the prior art.

The paper web splice tape of the present invention does not require that the carrier strip be perforated, as was necessary in various ones of the prior devices. This is due to the provision of multiple zones of varying adhesive strength in the present splice tape. An even separation of the paper web splice tape from the second layer of paper web on the standby roll is thus insured. This means that the web splice is accomplished smoothly and without tearing of the paper web.

The splicing zone, when using the paper web splice tape in accordance with the present invention, is before, in the direction of web travel, the tear off area of the splicing tape with the second layer of web on the standby roller in contrast with prior art devices in which the tear off area was before the splicing zone. This relocation of the splicing area, and enlargement of the tear-off zone provided by the present invention insures that the two webs to be spliced will be safely and securely connected together as the tear-off zones then increase continuously from zero to that required for a complete separation of the first layer of the new web from the underlying layer during the flying web splice.

The paper web splice tape in accordance with the present invention is of uniform, symmetrical cross-section. This allows the splice tape to be stored on a roll and to thus be easily wound up, stored, and dispensed.

It will thus be seen that the paper web splice tape in accordance with the present invention overcomes the limitations of the prior art devices. As such, it is a substantial advance in the art.

BRIEF DESCRIPTION OF THE DRAWINGS

While the novel features of the paper web splice tape in accordance with the present invention are set forth with particularity in the appended claims, a full and complete understanding of the invention may be had by referring to the detailed description of the preferred embodiments which are set forth subsequently, and as illustrated in the accompanying drawings, in which:

DESCRIPTION OF THE PREFERRED EMBODIMENTS

Figure 1:
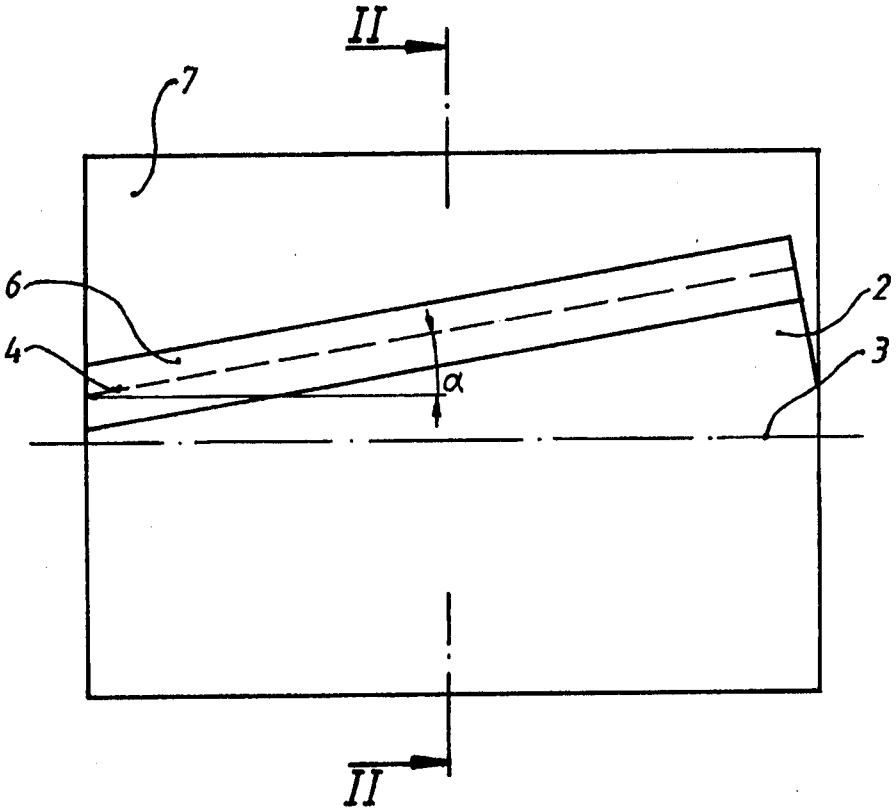
FIG. 1 is a front view of a new standby roll having a paper web splice tape in accordance with the present invention applied to it.

Referring initially to FIG. 1, there is shown a front view of a new standby paper web roll, generally at 1, which has been prepared using the paper web splice tape, generally at 6, in accordance with the present invention, to accomplish a flying web splice. As may be seen in FIG. 2, the paper web on the new standby paper web roll 1 is to be spliced to a depleting web 8 that is being pulled off a depleting roll 9. Since it is desired to effect the web splice in a manner which will have the least disruption on the operation of the printing press, it is desired that the paper web splice be accomplished on the fly; i.e. without stopping of the paper web feed.

Referring again primarily to FIG. 1, a free end 2 of an upper or first layer of the paper web on the new standby roll 1 is cut at an angle $\alpha$ with respect to the central longitudinal axis 3 of the standby roll 1. This angle is preferably in the range of between 10° to 30° above the horizontal central axis 3.

As will be discussed now in greater detail, the paper web splice tape 6 is used to secure a leading edge 4 of the free end 2 of the first or outer layer of the paper web on the new standby roll 1 to the surface of an underlying or second web layer 7 on the new standby roll 1, as may be seen in more detail in FIGS. 3–6. This securement of the free end 2 of the first or outer layer to the second layer 7 of paper on the new standby web roll 1 keeps the web rolled while it is in its standby position. As may be seen most clearly in FIG. 3, the paper web splice tape, generally at 6, is a double adhesive sided tape and has a central glue carrier layer or tape 11. This central carrier tape has a continuous, high strength adhesive coating or layer 12 on a first surface. In use, the paper web splice tape 6 is applied to the new standby roll 1 so that this continuous high strength adhesive 12 is facing outwardly so that it can be engaged by the depleting web 8 which, as may be seen in FIGS. 2–6 is running adjacent the surface of the new standby paper web roll 1. This continuous high strength outer adhesive layer 12 has sufficient adhesive strength to enable it to securely bond to the surface of the depleting web 8 during the flying web splice.

Figure 3:
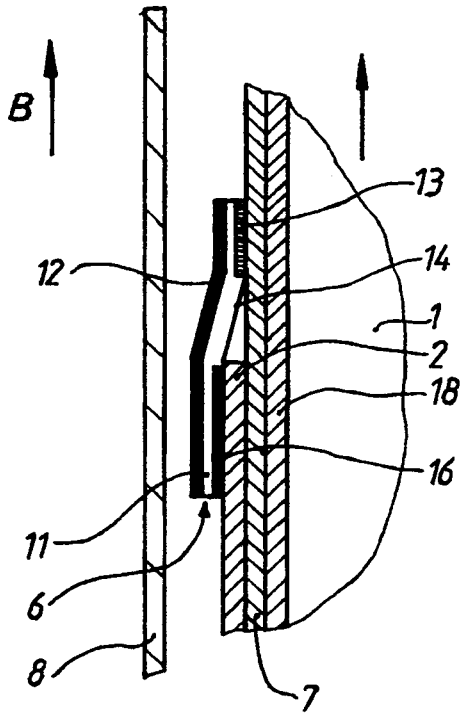
FIG. 3 is an enlarged side elevation view of the encircled area X in FIG. 2 showing the paper web splice tape in position in advance of a flying web splice.
Figure 4:
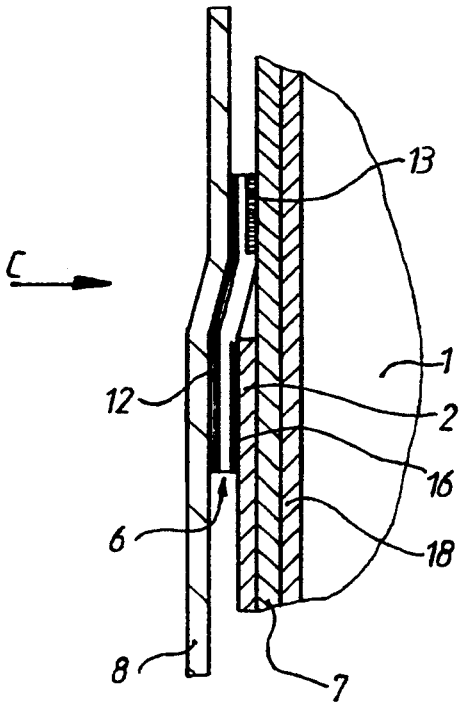
FIG. 4 is a view similar to FIG. 3 and showing the webs in splice position.
Figure 5:
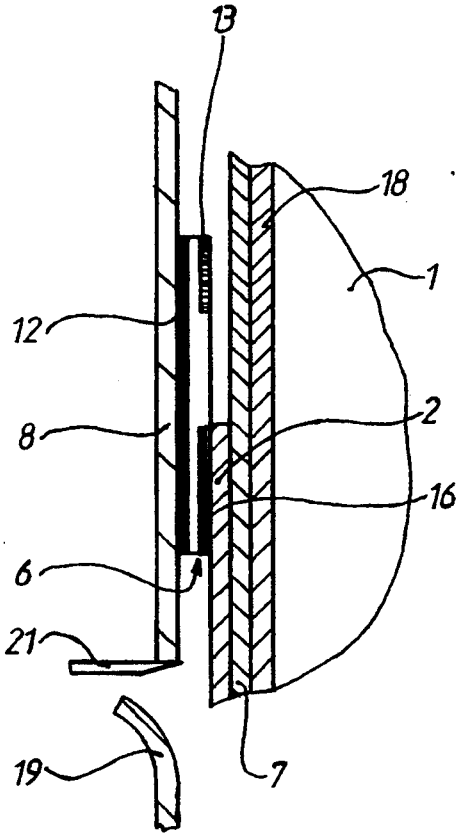
FIG. 5 is a view similar to FIG. 3 and showing the webs in spliced position.

As may be seen in FIGS. 3–6, the paper web splicing tape 6 is a double sided adhesive tape. The second or inwardly facing surface of the splice tape 6, as seen in FIGS. 3–5 has three separate areas or zones with different responsibilities. A first zone or band 13 which is located along a longitudinal leading, in the direction of web travel indicated by arrow B, portion of the inner surface of the carrier tape 11 is provided as an easily releasable one-time adhesive layer 13. This first band 13 is followed by a central zone 14 which is an adhesive free zone. A third, trailing zone is provided with a high strength adhesive layer 16. When the paper web splice tape 6 in accordance with the present invention is applied to the surface of the new standby paper web roll 1, the trailing, high strength adhesive zone 16 on the inner surface of the carrier tape 11 is applied along the free end 2 of the first or outer paper web layer. Since this trailing zone 16 has a high strength adhesive, it bonds aggressively to the free end of the new standby paper web roll 1. The boundary between the trailing zone of the high strength adhesives 16 and the non-adhesive zone 14 on the inner surface of the carrier tape 11 is aligned with the front edge 4 of the leading or free end 2 of the paper web. The provision of the central adhesive free zone 14 allows for some inaccuracy in alignment of the paper web splice tape 6 on the free end 2 of the first layer of paper web on the new standby roll 1. It is important that the trailing, high strength adhesive zone 16 not contact the second layer of paper 7 on the new standby paper web roll 1. It is the task of the easily releasable one time adhesive layer 13 to engage the second layer 7 of the paper web roll 1. This insures that this portion of the paper web splice tape 6 will separate smoothly and cleanly from the second layer 7 of the paper web during a flying splice. A third layer 18 of paper web on the new standby paper web roll 1 is also shown in FIG. 3.

Figure 2:
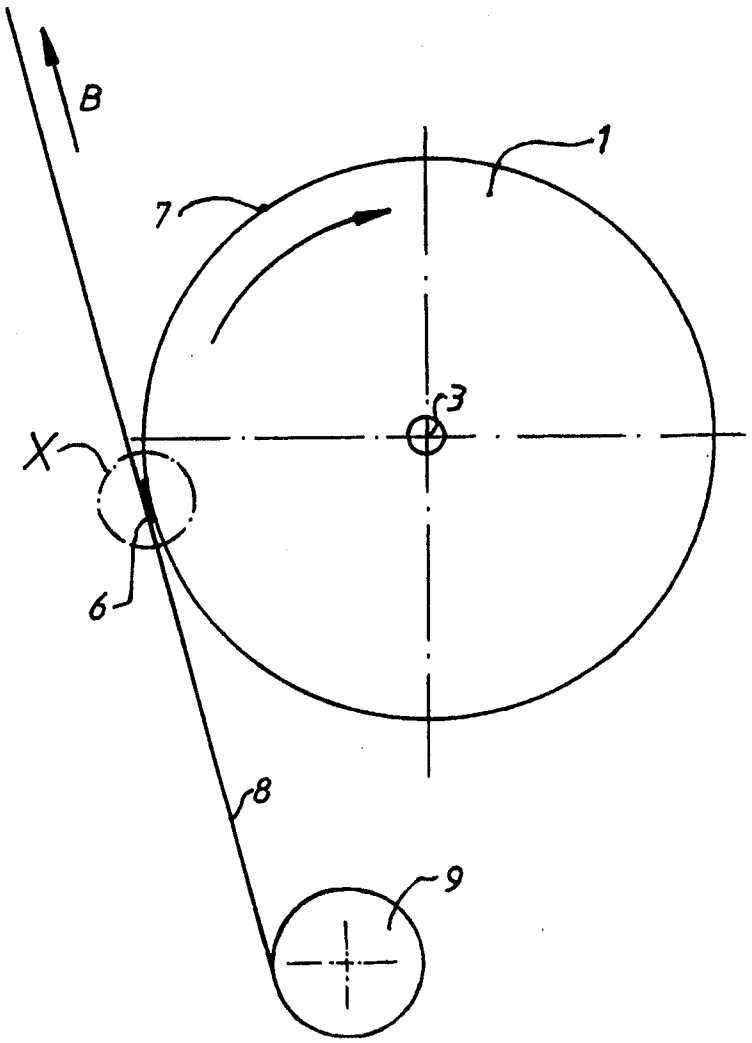
FIG. 2 is a schematic side elevation view taken generally in the direction indicated at lines II—II in FIG. 1 and showing a flying web splice being made.

In use, the paper web splice tape, generally at 6, in accordance with the present invention, is applied to the free end 2 of the first layer of the paper web roll 1 in any manual or mechanically assisted manner. As indicated previously, the front edge 4 of the free end 2 of the paper web should be aligned with the leading edge of the high strength adhesive 16 in the third or trailing zone of the inner side of the carrier tape 11. The easily releasable, one time adhesive layer in the leading zone 13 is secured to the second layer 7 of the paper. The continuous high strength adhesive layer 12 on the outer surface of the carrier tape 11 of the paper web splice tape 6 faces radially outwardly and is ready to be contacted by the depleting web 8 that is being fed off the depleting roll 9, as shown in FIG. 2. As may be seen in FIG. 4, the new standby paper web roll 1 is initially brought from a rest position up to a rotational speed, by a suitable peripheral speed accelerator (not shown) which engages the circumference of the roll 1, so that the rotational speed of the roll 1 is the same as the linear speed of travel of the depleting web 8. Then a pressure force is exerted against the depleting web 8 in the direction toward the splice tape 6 on the outer surface of the new standby web roll 1, as indicated by the arrow C in FIG. 4. This force may be exerted by a suitable pressure roller or the like, which is not specifically shown in the drawings. At the instant that the depleting web 8 is forced against the outer continuous high strength adhesive surface 12 of the paper web splice tape 6, as seen in FIG. 4, the paper web splice is accomplished. Since the outer adhesive layer 12 is high strength, it will adhere tenaciously to the inner surface of the depleting paper web 8.

Turning now to FIG. 5, once the depleting web 8 has been adhered to the outer adhesive layer 12 of the splice tape 6, the free first layer 2 will start to feed off the now active roll 1. The easily releasable one time adhesive layer 13 in the first, leading zone of the inner surface of the carrier tape 11 of the splice tape 6 will easily separate from the second layer 7 of the paper web on the now active roll 1. This easily releasing adhesive 13 does not leave any glue residues or contaminants on the second layer 7 of the paper web and also does not leave any glue residues in the printing machine. A trailing portion 19 of the now depleted web 8 is severed by a suitable knife blade that is schematically represented at 21 in FIG. 5 once the flying paper web splice has been accomplished.

Figure 6:
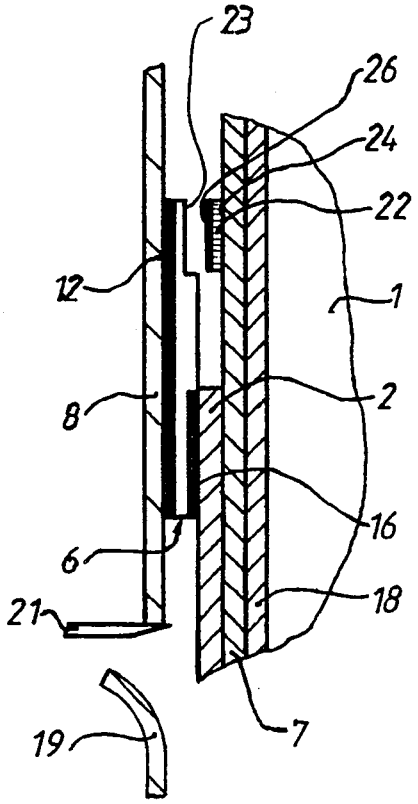
FIG. 6 is a view similar to FIG. 5 and showing a second preferred embodiment of a paper web splice tape in accordance with the present invention in spliced position.

A second preferred embodiment of a paper web splice tape in accordance with the present invention is shown generally at 6 in FIG. 6. In both preferred embodiments, the same numerals are used to identify similar elements. In this second preferred embodiment, the easily releasable leading zone on the inner side of the carrier tape 11 of the paper web splice tape 6 is formed by using a suitable strong adhesive 24 which is joined to the carrier tape 11 by a separable cleavage adhesive 22 that is a one time adhesive. In this second embodiment, when, as seen in FIG. 6, the depleting web 8 is pressed against the continuous high strength adhesive 12 on the outer surface of the carrier tape 11, the cleavable adhesive 22 is torn off or separated from the leading zone of the inner surface of the carrier tape 11. Since this cleavable adhesive 22 is a one-time adhesive, the strong adhesive 24 that remains on the second layer 7 of the new paper web roll, once the free first layer 2 has been adhered to the depleted web 8, will not leave an adhesive residue or contaminant as it passes through the printing press. Accordingly, no glue residues will be imparted to the rollers or cylinders in the press.

In the preferred embodiment of the invention, as shown in FIG. 1, the free end of the first layer of the paper web on the roll 1 is cut in a generally straight line that is inclined at the angle $\alpha$ to the central, longitudinal axis 3. This free end 2 could also be formed in other shapes, such as a V-shape, a U-shape or a number of arrow head shapes. These different shapes will change the angle $\alpha$. Since the paper web splice tape 6 of the present invention is in the form of an elongated strip, it can be cut into any desired length and applied to a web free end that has any desired shape.

The transverse width of the high strength continuous adhesive strip 12 can be varied and especially can be enlarged as needed to accomplish a secure flying web splice. In the past, splice preparations, in the form of arrows with long arrow shafts, were often necessary. This is no longer necessary when using the paper web splice tape 6 of the present invention.

While the areas of adhesive 13, 16 and 22 and 24 in the first and second preferred embodiments have been shown in FIGS. 3–6 as being embedded in the inner surface of the carrier tape 11, it will be understood that these adhesive layers could be applied to the inner surface of the carrier tape 11 instead of being embedded therein.

In the preferred embodiment of the paper web splice tape 6 in accordance with the present invention, the high strength adhesive used to form the continuous outer high strength adhesive layer 12 and the high strength adhesive layer 16 on the trailing zone on the inner layer of the carrier strip 11 or the layer 24 on the leading zone in the second embodiment have a pull strength of 7.5 Newtons per 25 mm tape width of an adhesive strip. The layer of easily releasable one time adhesive 13 in the leading zone on the cleavable adhesive 22 used in the second embodiment have a pull strength of 0.6 Newtons per 25 mm tape width of an adhesive strip. Any suitable, commercially available adhesives which meet these criteria can be used in the present invention.

While preferred embodiments of a paper web splice tape in accordance with the present invention have been set forth fully and completely hereinabove, it will be apparent to one of skill in the art that a number of changes in, for example, the overall size of the paper web roll, the means used to accelerate it to a suitable peripheral speed, the specific web severing means and the like could be made without departing from the true spirit and scope of the present invention which is accordingly to be limited only by the following claims.

What is claimed is:

1. A paper web splice tape usable to splice a leading edge of a new paper web roll to a depleting paper web, said paper web splice tape comprising:

a central elongated continuous carrier tape having a first outwardly facing surface and a second inwardly facing surface, said first and second surfaces being opposing;

first and second spaced longitudinally extending, inwardly facing zones on said second surface of said carrier tape, said first and second zones being spaced by a central, longitudinally extending zone, said first, second and central zones extending continuously along the length of said carrier tape;

a high strength continuous adhesive layer applied directly to and completely covering said first outwardly facing surface of said carrier tape and having an outwardly facing high strength adhesive surface, said outwardly facing high strength adhesive surface being directly securely adherable to a depleting paper web;

a high strength adhesive band applied directly to and completely covering said longitudinally extending, inwardly facing first zone of said second surface of said carrier tape and having an inwardly facing high strength adhesive surface, said inwardly facing high strength adhesive surface being directly engageable with an outer surface of a free end of a first layer of a new paper roll;

an easily releasable adhesive band applied directly to and completely covering said longitudinally extending, inwardly facing second zone of said second surface of said carrier tape and having an inwardly facing easily releasable adhesive surface, said inwardly facing easily releasable adhesive surface being directly releasably engageable with an outer surface of a second layer of a new paper web roll adjacent a free end of a new paper roll; and an adhesive free inwardly facing area formed by said central zone on said second surface of said carrier tape, said adhesive free area separating said high strength adhesive band applied to said first zone from said easily releasable adhesive band applied to said second zone and overlying an edge of a free end of a first layer of a new paper roll when said paper web splicing tape is applied to a new paper roll.

2. The paper web splice tape of claim 1 wherein said paper web splice tape has a uniform cross-section.

3. The paper web slice tape of claim 1 wherein said easily releasable adhesive band is a one time adhesive layer.

* * * * *